US008006795B2

(12) United States Patent
Manor

(10) Patent No.: US 8,006,795 B2
(45) Date of Patent: Aug. 30, 2011

(54) DEVICE AND METHOD FOR REGAINING BALANCE

(76) Inventor: Yonatan Manor, Haifa (IL)

( * ) Notice: Subject to any disclaimer, the term of this patent is extended or adjusted under 35 U.S.C. 154(b) by 0 days.

(21) Appl. No.: 11/579,184

(22) PCT Filed: May 3, 2005

(86) PCT No.: PCT/IL2005/000467

§ 371 (c)(1),
(2), (4) Date: Oct. 30, 2006

(87) PCT Pub. No.: WO2005/104660

PCT Pub. Date: Oct. 11, 2005

(65) Prior Publication Data

US 2008/0093144 A1 Apr. 24, 2008

Related U.S. Application Data

(60) Provisional application No. 60/567,502, filed on May 4, 2004.

(51) Int. Cl.

| | |
|---|---|
| ***A63B 23/08*** | (2006.01) |
| ***A63B 23/10*** | (2006.01) |
| ***A63B 71/00*** | (2006.01) |
| ***A63C 5/08*** | (2006.01) |
| ***A63C 17/12*** | (2006.01) |

(52) U.S. Cl. ..... 180/181; 482/8; 482/79

(58) Field of Classification Search ..... 482/71, 482/70, 1–9, 51, 79; 280/11.19, 11.204, 280/814; 180/65.1, 65.51, 65.6, 180–181; *A63B 23/08, 23/10, 71/00; A63C 5/08, 17/12*
See application file for complete search history.

(56) References Cited

U.S. PATENT DOCUMENTS

| | | | | | |
|---|---|---|---|---|---|
| 4,050,171 | A | * | 9/1977 | Teach | 37/348 |
| 4,691,453 | A | * | 9/1987 | Tifre | 36/8.3 |
| 4,703,445 | A | * | 10/1987 | Dassler | 702/160 |
| 5,179,792 | A | * | 1/1993 | Brantingham | 36/29 |
| 5,249,376 | A | * | 10/1993 | Capria | 36/115 |
| 5,286,043 | A | * | 2/1994 | Tkaczyk | 280/11.223 |
| 5,388,350 | A | * | 2/1995 | Parker, Jr. | 36/115 |
| 5,437,289 | A | * | 8/1995 | Liverance et al. | 600/592 |

(Continued)

OTHER PUBLICATIONS

International Search Report for International Application No. PCT/IL2005/000467 mailed Apr. 7, 2006.

*Primary Examiner* — Loan Thanh
*Assistant Examiner* — Oren Ginsberg
(74) *Attorney, Agent, or Firm* — Pearl Cohen Zedek Latzer, LLP

(57) ABSTRACT

A device and method for assisting a user in regaining his balance is disclosed. The device comprises: at least one sensor for sensing changes in weight distribution on any of the feet of the user, at least one propulsion unit to be coupled to any of the feet of the user for displacing a foot of the user when a change in the weight distribution on that foot reaches a predetermined condition; and a controller for receiving signals from the sensor indicative of the predetermined condition and activating the propulsion unit. When the predetermined condition is determined the propulsion unit displaces a foot of the user mechanically in a direction that results in the repositioning of the support area of the user beneath the center of mass of the user, thus allowing the user to regain balance.

17 Claims, 18 Drawing Sheets

U.S. PATENT DOCUMENTS 5,449,002 A * 9/1995 Goldman ..... 600/592
5,730,241 A 3/1998 Shyr et al.
5,794,361 A * 8/1998 Sadler ..... 36/29
5,813,142 A * 9/1998 Demon ..... 36/29
5,864,333 A 1/1999 O'Heir
5,895,340 A * 4/1999 Keller ..... 482/71
5,947,486 A * 9/1999 Zell ..... 280/11.201
6,050,357 A * 4/2000 Staelin et al. ..... 180/65.1
6,059,062 A * 5/2000 Staelin et al. ..... 180/181
6,239,501 B1 * 5/2001 Komarechka ..... 290/1 R
6,255,799 B1 * 7/2001 Le et al. ..... 320/107
6,450,509 B2 9/2002 Adams
6,536,785 B2 * 3/2003 Lee ..... 280/11.27
6,629,698 B2 * 10/2003 Chu ..... 280/11.19
6,836,744 B1 * 12/2004 Asphahani et al. ..... 702/141
7,107,706 B1 * 9/2006 Bailey et al. ..... 36/88
7,174,976 B2 * 2/2007 Kamen et al. ..... 180/19.1
7,186,270 B2 * 3/2007 Elkins ..... 623/24
7,195,251 B2 * 3/2007 Walker ..... 280/11.19
7,204,041 B1 * 4/2007 Bailey et al. ..... 36/29
7,219,449 B1 * 5/2007 Hoffberg et al. ..... 36/88
7,261,305 B2 * 8/2007 Cole ..... 280/87.042
7,290,354 B2 * 11/2007 Perenich ..... 36/27
7,303,032 B2 * 12/2007 Kahlert et al. ..... 180/65.1
7,350,787 B2 * 4/2008 Voss ..... 280/5.5
7,370,713 B1 * 5/2008 Kamen ..... 180/7.1
7,383,908 B2 * 6/2008 Tuli ..... 180/181
7,395,614 B1 * 7/2008 Bailey et al. ..... 36/28
7,552,021 B2 * 6/2009 Bar-Haim et al. ..... 702/97
7,610,972 B2 * 11/2009 Adams et al. ..... 180/65.1
7,621,850 B2 * 11/2009 Piaget et al. ..... 482/54
2001/0022433 A1 * 9/2001 Chang ..... 280/11.19
2001/0032743 A1 * 10/2001 Kamen et al. ..... 180/7.1
2001/0033145 A1 * 10/2001 Filo ..... 318/568.12
2004/0007835 A1 * 1/2004 Yang ..... 280/11.19
2004/0066011 A1 * 4/2004 Chu et al. ..... 280/11.19
2004/0173220 A1 * 9/2004 Harry et al. ..... 128/892
2004/0239056 A1 * 12/2004 Cho et al. ..... 280/7.1
2005/0184878 A1 * 8/2005 Grold et al. ..... 340/573.7
2005/0233859 A1 * 10/2005 Takai et al. ..... 482/3
2005/0261609 A1 * 11/2005 Collings et al. ..... 600/592
2006/0022417 A1 * 2/2006 Roderick ..... 280/11.19
2006/0079800 A1 * 4/2006 Martikka et al. ..... 600/546
2008/0051686 A1 * 2/2008 Ashihara ..... 602/28
2008/0134541 A1 * 6/2008 Bar-Haim et al. ..... 36/27

* cited by examiner

DEVICE AND METHOD FOR REGAINING BALANCE

CROSS-REFERENCE TO RELATED APPLICATIONS

This application is a National Phase Application of PCT International Application No. PCT/IL2005/000467, entitled "Device and Method for Regaining Balance", International Filing Date May 3, 2005, published on Nov. 10, 2005 as International Publication No. WO 2005/104660; which in turn claims priority from U.S. Provisional Application No. 60/567,502, filed May 4, 2004.

FIELD OF THE INVENTION

The present invention relates to device and method for assisting a person in regaining his or hers balance, while walking or standing. The invention is particularly useful for old people, disabled people, and any other group of people with gait and standing difficulties.

BACKGROUND OF THE INVENTION

People may lose their balance for many reasons. Some may trip over an obstacle, lose their balance and fall. Others may lose their balance sensation, so that they can no longer stand or walk safely. Old people, in particular, may be slow in responding to changes in their balance; consequently they may have difficulties in regaining balance, when encountering sudden weight shifts (forward, backwards or sideways). By the time they react and try to move a foot, to regain balance, the fall process has already progressed beyond prevention. Some old people use a walking cane or a four-legged support device that provides them with a stabilizing moment to support any sway of their body weight. Such supporting devices are cumbersome, heavy to carry, and some are reluctant to use them because they view these devices as degrading.

Typically, a person is said to be in balance, when his center of mass is positioned over his support area.

The support area of each foot is the contact area of that foot with the surface below, and if a person is standing with one foot up (in a stationary position) his center of mass would have to be over the support area of the foot which is in contact with the ground. If a person is standing stationary, then his center of mass lies within the combined support area of his both feet, which is the area physically covered by the feet and the area between them.

When a person walks, his center of mass (together with his inertial momentum) shifts in position between both his feet. This is a dynamic state that evolves during the gait of the person (see FIG. 7*d*, that illustrates the shift in the center of mass in normal gait, and FIG. 7*e*, that illustrates the shift in the center of mass in typical elderly people).

The present invention addresses situations of loss of balance, both in static cases (when a person is stationary) and dynamic cases (when a person is walking).

The problem of falling is related to the mechanism in which a standing person maintains his balance. The sensory elements of the brain interpret, any shift of the body's center of weight, relative to both feet, by sensing the distribution of weight of the body over the support area of the feet. A shift of body weight forward or backward can be detected by sensing the weight distribution between the front and back areas of the foot. A shift of body weight sideways can be detected by sensing the weight distribution between the two legs.

In a standing position, when the body feels any imbalance toward the back it tries to counter it by moving more weight support to the heels. This creates a forward torque that returns the center of body weight forward, above the feet. When the body feels imbalance toward the front, it gives more support to the front of the foot, pushing the body center to the back. When the body experiences weight imbalance to one of the sides it shifts more support to that side. If a person is too slow to respond the center of weight may move over the heels, toes or over one of his legs, and balance may be regained only by displacing the foot and executing a step. For older people who may be weak and slow to response, the foot movement may come too late, thus a fall may be inevitable.

A main object of the present invention is to provide a device and method for assisting the user in regaining balance, by moving his foot in the desired direction, such that the center of body weight is returned over the support area Automatic servo walking tools have been demonstrated before. They are based on the mechanism of walking by shifting the legs position in steps. They have never become practical in use because of the large electric motors necessary to assist the human body walking mechanism, and the lack of low weight power source in the form of electric batteries. Another aim of the present invention, is to facilitate a shift of the body weight with a burst of power that is needed only for intermittent periods, thus assisting the user in regaining his balance. Using only power bursts for regaining balance enables the device to be based on a simple low cost battery to power a motor.

SUMMARY OF THE INVENTION

There is thus provided, in accordance with some preferred embodiments of the present invention, a device for assisting a user in regaining his balance, the device comprising:

at least one sensor for sensing changes in weight distribution on any of the feet of the user;

at least one propulsion unit to be coupled to any of the feet of the user for displacing a foot of the user when a change in the weight distribution on that foot reaches a predetermined condition;

a controller for receiving signals from said at least one sensor indicative of the predetermined condition and activating the propulsion unit, whereby, when the predetermined condition is determined the propulsion unit displaces a foot of the user mechanically in a direction that results in the repositioning of the support area of the user beneath the center of mass of the user, thus allowing the user to regain balance.

Furthermore, according to some preferred embodiments of the present invention, the propulsion unit comprises a motor coupled to a revolving element.

Furthermore, according to some preferred embodiments of the present invention, the revolving element comprises at least one wheel.

Furthermore, according to some preferred embodiments of the present invention, the revolving element is a belt.

Furthermore, according to some preferred embodiments of the present invention, the propulsion unit is provided with a surface of enhanced friction.

Furthermore, according to some preferred embodiments of the present invention, the propulsion unit is powered by at least one battery.

Furthermore, according to some preferred embodiments of the present invention, said at least one sensor is selected from the group consisting of: weight activated mechanical switches, strain gauges, piezoelectric sensors, electronic sensors.

Furthermore, according to some preferred embodiments of the present invention, the device is incorporated in at least one shoe Furthermore, according to some preferred embodiments of the present invention, the device is integrated in at least one shoe.

Furthermore, according to some preferred embodiments of the present invention, the device is further provided with a communication unit for communicating information to or from an external unit.

Furthermore, according to some preferred embodiments of the present invention, the device also includes a receiver for receiving information from a communication unit associated with other foot of the user.

Furthermore, according to some preferred embodiments of the present invention, the propulsion unit provides propulsion for displacing the foot of the user along one axis.

Furthermore, according to some preferred embodiments of the present invention, the propulsion unit provides propulsion for displacing the foot of the user along more than one axis.

Furthermore, according to some preferred embodiments of the present invention, there is provided a method for assisting a user in regaining his balance, the method comprising:

providing at least one sensor for sensing changes in weight distribution on any of the feet of the user;

providing at least one propulsion unit to be coupled to any of the feet of the user for displacing a foot of the user when a change in the weight distribution on that foot reaches a predetermined condition;

providing a controller for receiving signals from said at least one sensor indicative of the predetermined condition and activating the propulsion unit, sensing changes in weight distribution on any of the feet of the user and displacing a foot of the user mechanically using the propulsion unit, when a change in the weight distribution on that foot reaches a predetermined condition, in a direction that results in the repositioning of the support area of the user beneath the center of mass of the user, thus allowing the user to regain balance.

Furthermore, according to some preferred embodiments of the present invention, the foot is moved along one axis.

Furthermore, according to some preferred embodiments of the present invention, the foot is moved along more than one axis.

Furthermore, according to some preferred embodiments of the present invention, the method further comprises providing communication unit for communicating information to or from an external unit.

Furthermore, according to some preferred embodiments of the present invention, information is communicated the communication unit and a communication unit associated with other foot of the user.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF PREFERRED EMBODIMENTS

A typical device for regaining balance, in accordance with a preferred embodiment of the present invention includes a propulsion unit for displacing the foot of the user, when a change in the weight distribution on that foot reaches a predetermined condition; a controller, which receives signals from at least one weight distribution sensor, and activates the propulsion unit, when the predetermined condition is met. In a preferred embodiment, the propulsion unit comprises of a motor coupled to a revolving element, which may, for example be a wheel, a set of wheels, or a revolving belt.

Figure 1:
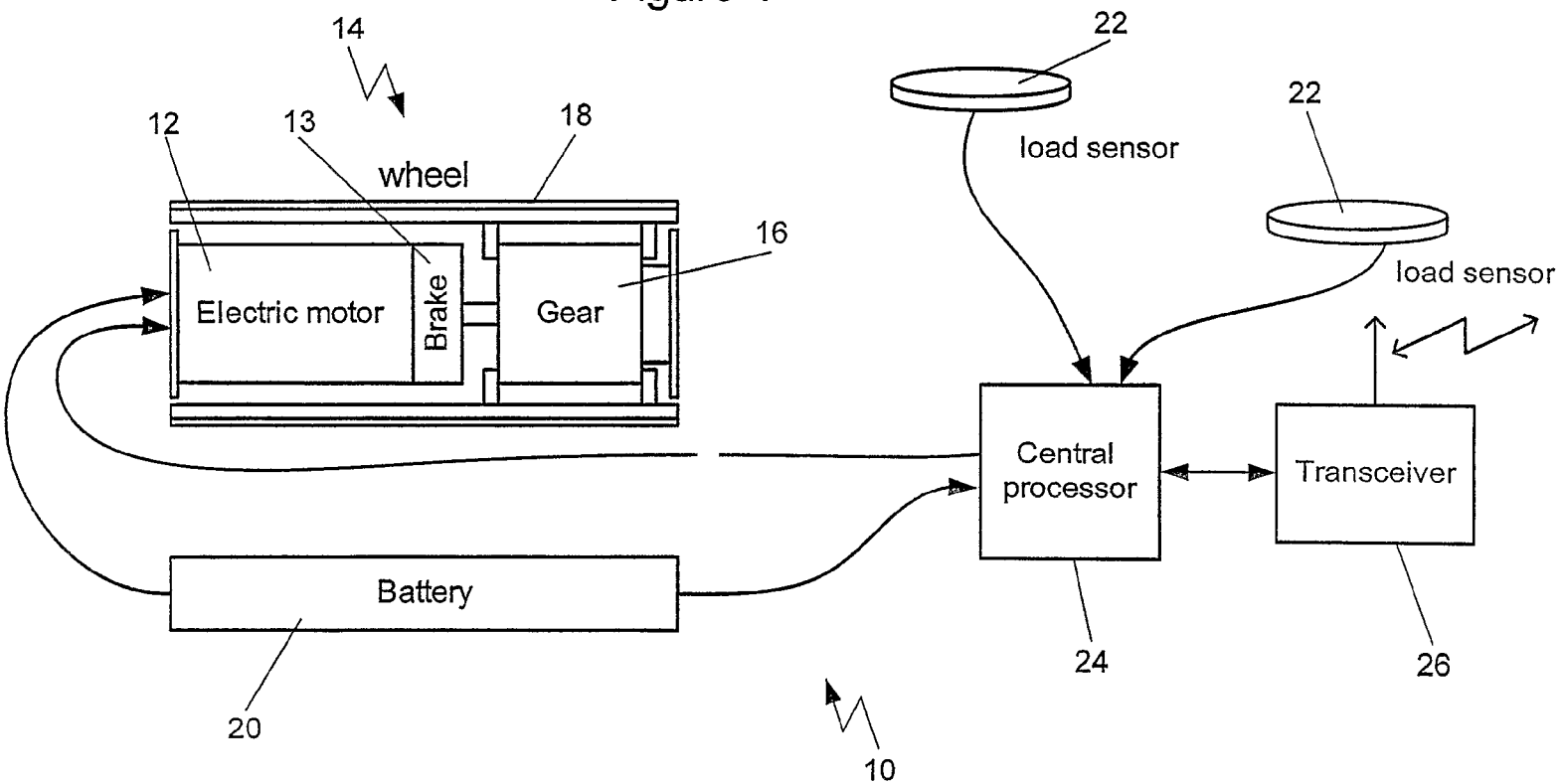
FIG. 1 is a diagram of a device for regaining balance, in accordance with a preferred embodiment of the present invention.

FIG. 1 is a diagram of a device for regaining balance (10), in accordance with a preferred embodiment of the present invention. The device is comprised of at least the following components: At least one (in this embodiment two) load sensor element (22) that produces electric signals reflecting the weight pressure imposed on it. The sensor elements can comprise mechanical switches activated by weight, strain gauge or piezoelectric sensing devices or any other mechanism that produces an electric signal reflecting changes in the distribution of weight of the person. The weight load sensors are connected to a controller, which can be, for example, a central processor (24). The processor samples the signal, from which it interprets the temporal load imposed on the sensors. The processor compares the loads to other loads or to any calculated threshold. It may also perform any type of logical calculations, to adjust the response to a sequence of events, which include standing and walking. The processor produces an electric command, which activates a propulsion unit (14). The propulsion unit (14) includes an electric motor (12) and a wheel (18). In the drawing of FIG. 1 the electric motor (14), a brake unit (13) and the gear (16) are confined within the wheel assembly to optimize the volume occupied by the system, but other arrangements are possible too. At least one battery (20) is used to power the propulsion unit and the processing unit. The system may also include a transceiver unit (26), which can receive and transmit information from and to the central processing unit. The transceiver may be used to communicate between the CPUs of two shoes equipped with a device in accordance with the present invention or to communicate with an external unit. Such an external unit can be placed, for example, at a doctor's clinic for monitoring the balance of a patient along a period of time. In yet another preferred embodiment, instead of using a transceiver, a separate transmitter or receiver may be used.

In another preferred embodiment the controller executes a logical algorithm that detects when the person is leaning to the back and load is released from the front of the foot and shifted to the back, and differentiate it from walking where the heel touches the ground before the front of the foot and load is shifted from the back to the front.

In another preferred embodiment the controller executes a logical algorithm that detects when a person is walking or standing and the pace of walking according to the sequence of load change between front and back of the foot, and synchronizes the activation of the propulsion unit to the timing of the foot placing on the ground.

In another preferred embodiment the controller executes a logical algorithm that detects when a person is seating according to the amount of load on the foot and avoid activating the propulsion unit when the person is not standing or walking.

In another preferred embodiment, the electric motor can be installed outside the wheel assembly. In another preferred embodiment the gear may also be installed outside the wheel assemble. The selected configuration depends on specific design parameters such as the dimensions of the electric motor and gear vs. the desired wheel dimensions.

A basic configuration of a device according to the present invention provides motion to the shoe in one direction. A system that provides motion in more than one direction includes two or more sets of wheels. The same motor, central processor and the same battery can serve to power the motion in all directions. Some of the sensors may be used to activate more than one set of wheels. In some configurations sensors can serve as load detectors for monitoring balance in more than one direction.

Figure 2B:
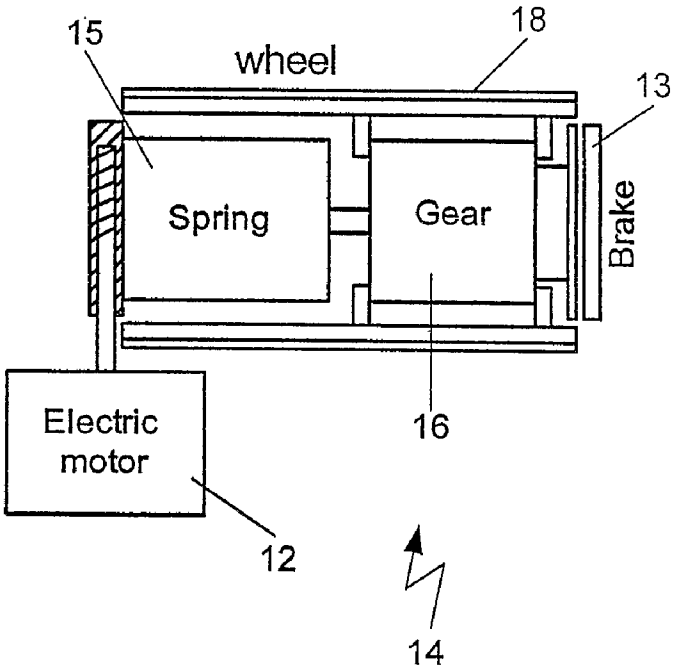
FIG. 2*b* is a schematic illustration of another design for a propulsion unit for a device for regaining balance, in accordance with a preferred embodiment of the present invention.
Figure 2A:
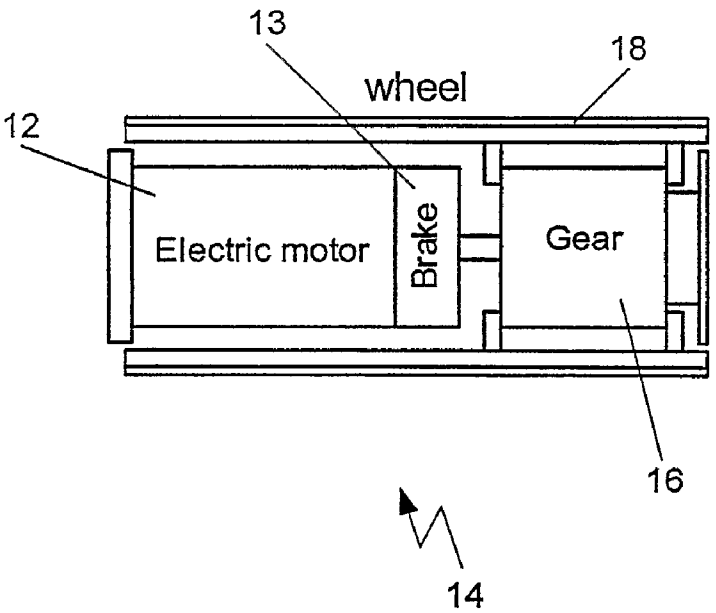
FIG. 2*a* is a schematic illustration of a propulsion unit of a device for regaining balance, in accordance with a preferred embodiment of the present invention.

FIGS. 2*a* and 2*b* present specific implementations of the propulsion unit (14). FIG. 2*a* presents a propulsion unit (14), wherein the electric motor (12) and the gear (16) are installed inside the wheel (18). The motor typically rotates at high speed that can reach as much as 10,000 RPM and more. It drives a planetary gear (16). The gear reduces the rotational speed for the drive wheel, to provide the desired linear motion of the shoe on the ground, at a typical velocity of about 10 cm/sec. The gear also provides the high torque required to move the shoe under the weight of a person. The gear is preferably designed to prevent rotation of the wheel under external forces. This may be achieved by the brake that prevents the wheels from rotating when not activated. This prevents the sole from inadvertently sliding on the ground under the person weight or any externally exerted forces. The wheel may be provided with an enhanced friction surface, like rubber or any other such material, to increase the grip of the shoe to the ground.

In cases where the electric motor is not powerful enough to drive the wheel a spring motor (15) can be used. FIG. 2*b* presents a particular embodiment of a spring motor mechanism installed inside the wheel assembly. The spring can provide high torque with a limited number of rotations. The spring (15) is loaded by an external electric motor (12) when the system is activated. The spring is connected to a gear mechanism (16) to reduce the rotational speed. An electric actuator releases the gear by receiving an electrical command signal from the central processor unit (24). The actuator releases the spring and allows it to drive the wheel via the gear. Once the spring is unloaded the electric motor reloads the spring for the next event.

Figure 3A:
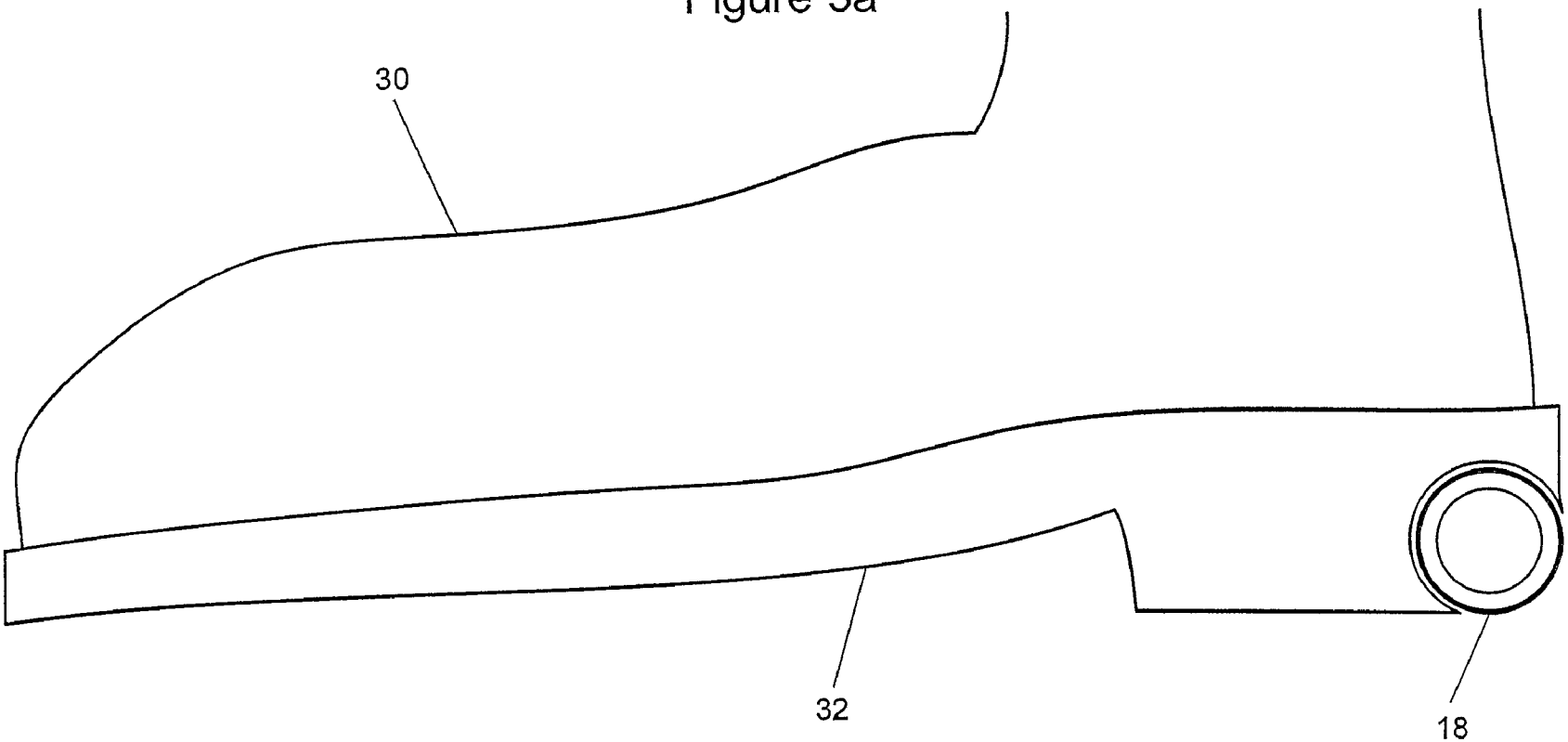
FIG. 3*a* illustrates a side view of a device for regaining balance, according to a preferred embodiment of the present invention, incorporated in the heel section of a sole of a shoe.

FIG. 3*a* present a preferred embodiment of the invention, where a single wheel (18) is integrated in a shoe (30). The wheel (18) is located at the back of the shoe sole (32), in the heel area. The wheel is closely leveled with the sole bottom and extends to the sole back end, such that it does not protrude outside the sole (32). When the person leans backward his weight is shifted onto the wheel at the back. Any rotation of the wheel will then move the sole on the ground. The wheel level, relative to the sole bottom, is designed such that most of his weight rests on the wheel when the sole flexes as the person leans to the back of the heel.

Figure 3B:
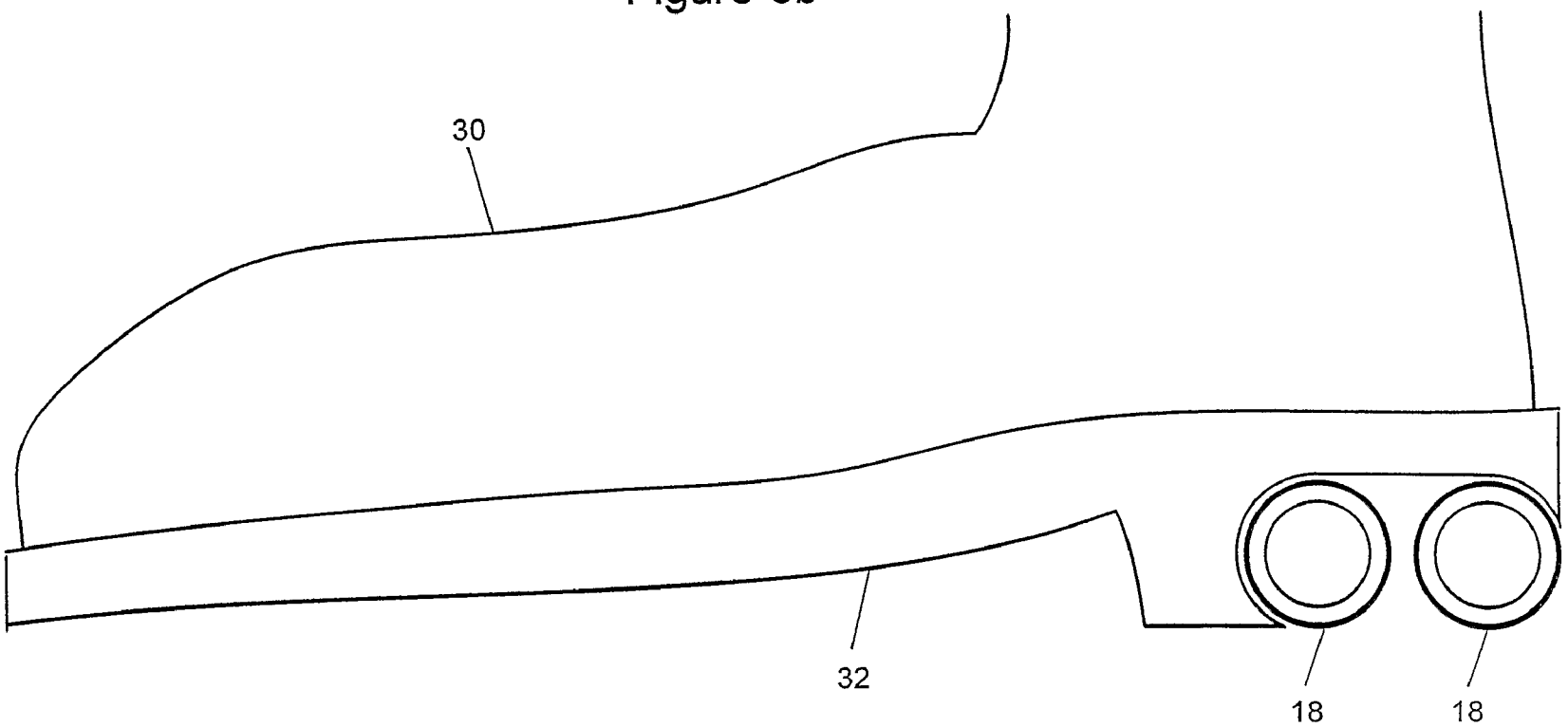
FIG. 3*b* illustrates a side view of another preferred embodiment of a device for regaining balance, incorporated in the heel section of a shoe, with a pair of wheels.

In another preferred embodiment, as presented in FIG. 3*b*, a second wheel (18) is mounted in parallel to the first wheel (18). The second wheel may include a drive motor and gear that operate together with the motor of the first wheel, or it may serve to support weight only. The second wheel provides flat support of the drive system on the ground and thus better traction.

Figure 3C:
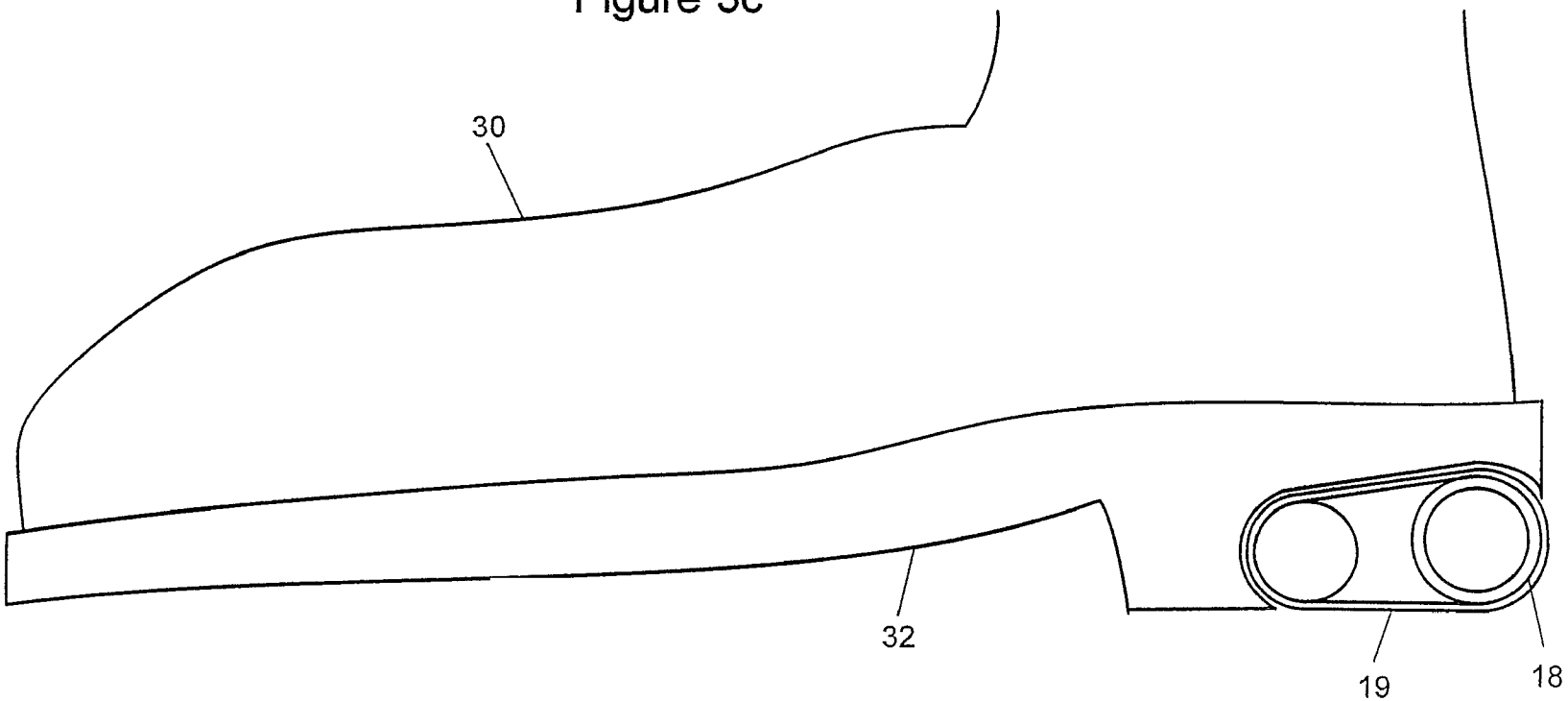
FIG. 3*c* illustrates a side view of another preferred embodiment of a device for regaining balance, incorporated in the heel section of a shoe, with a rotating belt.

Yet in another preferred embodiment, as presented in FIG. 3*c*, a belt (19) is installed between two wheels (18). The belt provides a larger area of support and better grip to the ground.

The weight distribution along a single foot and between the user's feet can be sensed using one or more sensors, which can comprise a strain gauge, piezoelectric or any other kind of sensor that produces an electric signal that indicates changes in the distribution of weight. The sensors can also be made of mechanical switches that produce a signal under a predetermined load. In a preferred embodiment, the sensors are installed inside a flexible sole, such that they are protected from the ground but feel the weight load. The sensors may also be installed inside the shoe below the insole of the foot. Sensors are installed for the detection of weight distribution in any desired direction. An example of sensor location in the shoe, designed to measure the weight shift toward the back and front, is presented in FIG. 4. Two sensors, or a single differential sensor that measure load difference between two sections of the sensor in any given direction, (22) are installed in the posterior (back) of the sole (32) (around the heel). The first sensor is installed at the base of the driving belt (19). The sensor may be installed between the belt assembly and the sole body to measure the weight load on the belt. A second sensor (22) is installed at the heel area, in front of the first sensor. The weight distribution between the two elements reflects the weight distribution inside the heel. A third sensor is installed in the anterior section of the sole (32). The weight distribution between the third sensor and the first two sensors reflect the weight distribution in the foot along the forward-backward axis.

Figure 5:
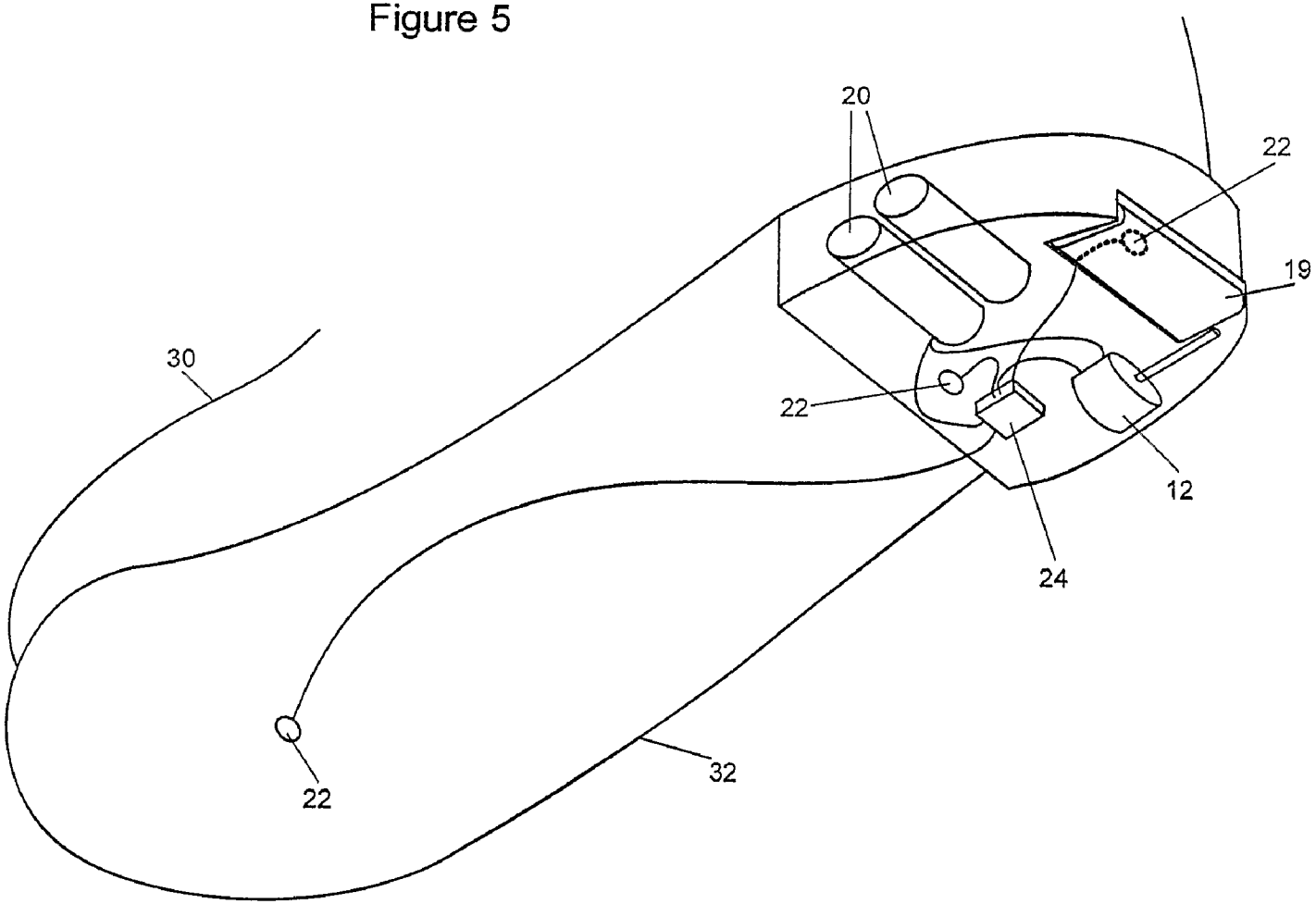
FIG. 5 illustrates a bottom view of the device shown in FIG. 4, showing additional components.

An example of one embodiment, wherein the device is integrated in a single shoe (30) is presented in FIG. 5. The example shows a device (10) designed with a single belt (19) at the back-end of the sole (heal area), for backward imbalance assistance. The system includes a belt assemble (19), an external motor (12); a central processor (24) and two batteries (20), all installed inside the heel area of the sole (32). Three sensors (22) are installed one above the belt assembly, a second in the heel and a third in the front sole. All are connected by embedded electric wires to the central processor (24). The complete system can be installed in the sole (32) and can be completely sealed to water and protected from wear and shock. The batteries can be mounted in housing that allows replacement or can be fixed permanently. Since the system uses power in short bursts, during emergency events, the capacity of a single charge may last for long usable hours.

Figures 6A, 6B, 6C:
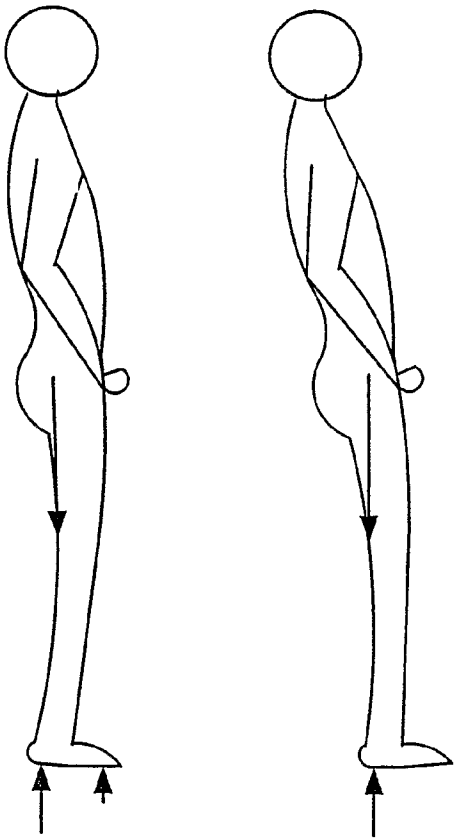
FIG. 6*a* is a schematic sideways illustration of the forces acting on a balanced standing person.
FIG. 6*b* is a schematic sideways illustration of the forces acting on a person on the verge of losing balance backwards.
FIG. 6*c* is a schematic sideways illustration of the forces acting on a person regaining balance by moving his foot backwards.

To better understand how the device assists in cases of loss of balance, one has to understand the balancing mechanism and the sequence of events associated with a fall of a person. FIG. 6*a* presents the forces acting on the feet to keep a standing person in balance posture, and preventing him from falling forward or backward. The body center of weight is countered by the forces acting on the heels and on the front section of the foot. Most of the weight is supported by the heel while the force on the front section of the foot serves mostly for balance. When the center of weight moves forward more force is exerted on the front section of the foot to push the body backward. When the center of weight moves backwards more force is exerted on the heel to move the body forward.

Figure 4:
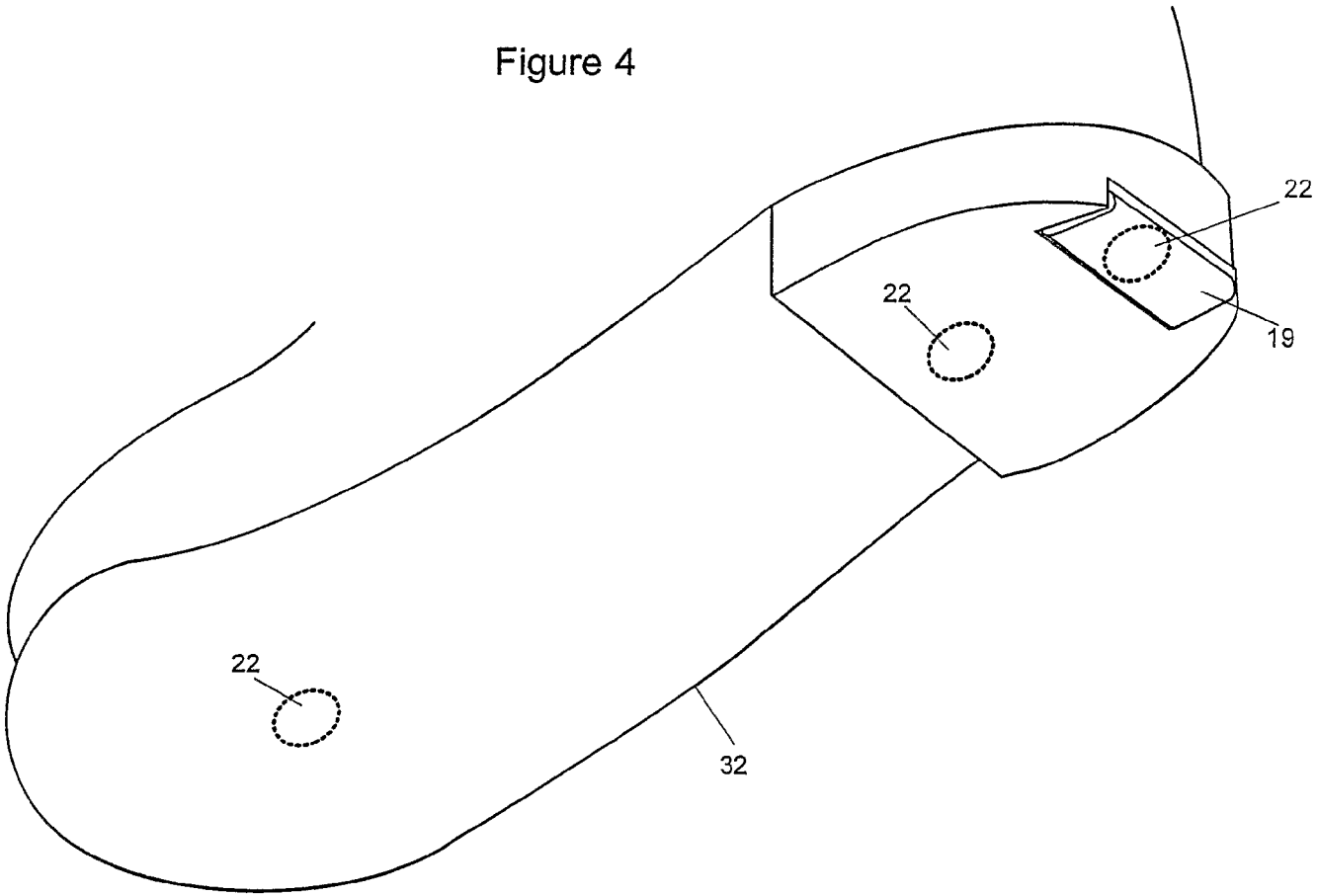
FIG. 4 illustrates a bottom view of a device for regaining balance, incorporated in the heel section of a shoe, with a rotating belt, showing a suggested sensor positioning scheme.
Figures 7A, 7B, 7C:
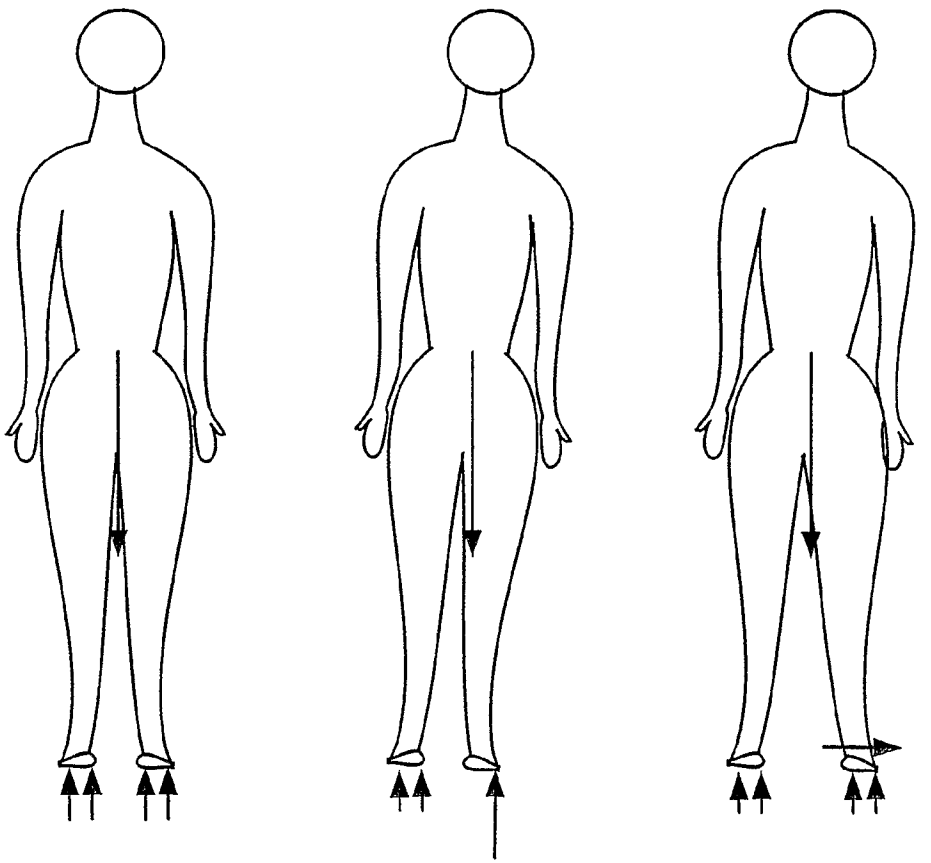
FIG. 7*a* is a schematic frontal illustration of the forces acting on a balanced standing person.
FIG. 7*b* is a schematic frontal illustration of the forces acting on a person losing balance toward his left side.
FIG. 7*c* is a schematic frontal illustration of the forces acting on a person regaining balance by moving his foot to his left.

The greatest "fear of fall" of elderly people is associated with a backward fall. This happens when the center of weight moves all the way back such that all the weight is supported by the heels, see FIG. 6*b*. At this stage a person has to move one foot backwards to prevent tripping backwards. Elderly people are slower to respond. When they reach this dangerous condition, presented in FIG. 6*b*, they may be too slow to lift their foot and move it backwards. As a result they are in danger of loosing their balance and falling. At this point the device of the present invention actively intervenes as illustrated in FIG. 6*c*. The device detects the imbalance condition, and activates the drive and the wheels, resulting in a movement of the foot backwards. This backward movement compensates for the person's inability to respond quickly enough, and intentionally move his foot backwards in time. The device of the present invention uses a person's instinctive reaction in imbalance situation such as presented in FIG. 6*b*. In this situation, a person instinctively leans to the back towards his heels, in an effort to move the support force as further back as possible. When he does so, most of the weight is concentrated on the wheel and on the rear weight sensor (FIG. 4). When the device senses these conditions it activates the propulsion unit, which moves the foot backwards. A short distance movement of the foot is enough to regain balance. Since the foot is displaced in the direction the person would have liked the foot to be placed, it does not conflicts with the person's natural balancing process While standing or walking, a person can also loose balance and fall sideways. FIGS. 7*a*-7*c* present the balancing mechanism in such a situation. FIG. 7*a* presents the forces acting on a person, standing in balance. The person's weight is distributed between his two legs. For each leg the weight is distributes evenly across the horizontal axis of his foot—the forces acting on the outer edge and inner edge of the foot are about equal. To balance the body the person moves his weight from one leg to the other. If the weight shifts too much toward one leg, a person tries instinctively to lean outward, thus exerting more force on the outer edge of the foot. A normal person, at this situation, will execute a cross over step with the other foot followed by a second sideway correction step with the first foot to regain balance. An old person will try a quick step with the free leg followed by a correction side step at a fast pace. He may be too slow to react and move his foot on time, thus he may lose his balance and fall. The device detects the imbalance in the foot supports. It then activates the side wheel set, which effectively moves the support area of the foot sideways as presented in FIG. 7*c*. This action results in the person regaining his balance. A person's natural balancing mechanisms for each leg are independent of each other; therefore there is no need for the device for regaining balance to synchronize its activity between the two shoes. However, communication and synchronization may be desired and can be incorporated in a device of the present invention when used on two feet. When a person walks, he shifts his weight from one foot to the other. When he losses his balance to one side, he tends to shift weight towards the outer edge of the foot on that side. The device detects this weight shift, and can react in a similar way, as in the standing conditions. The need, to assist the foot in moving and reposition itself, is critical only, when the weight shifts to the outward side of the foot. Imbalance to the inside is easily compensated by the second foot support.

Figure 7E:
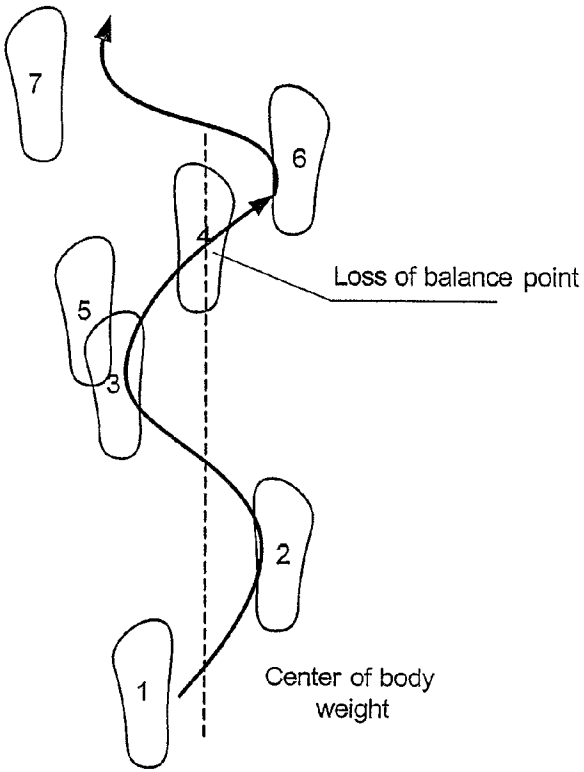
FIG. 7*e* is a schematic illustration of the shifting of the center of mass during gait of a person with a balance disability or slow responses, and the regaining of balance after momentary loss of balance.
Figure 7D:
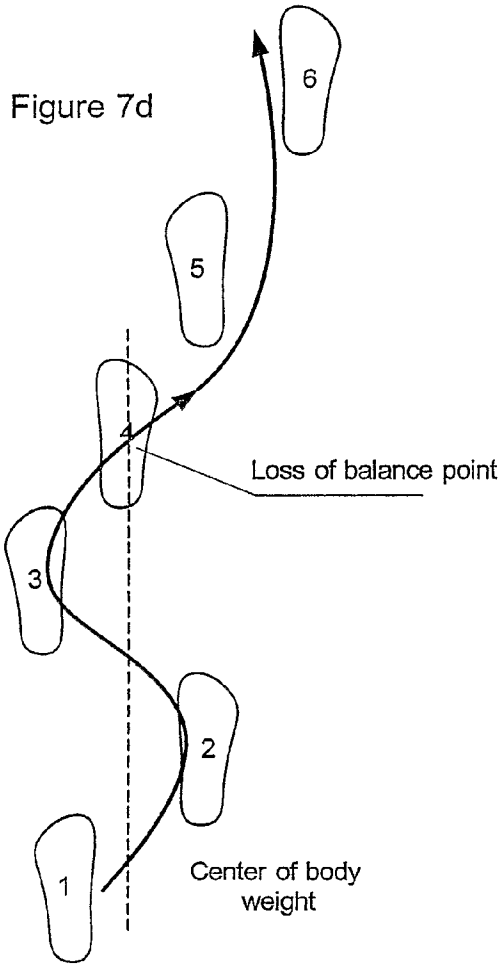
FIG. 7*d* is a schematic illustration of the shifting of the center of mass during typical gait, and the regaining of balance after momentary loss of balance.

FIG. 7*d* is a schematic illustration of the shifting of the center of mass during typical gait, and the regaining of balance after momentary loss of balance. At first a person steps a series of balanced steps (1, 2, 3), at either sides of the imaginary line representing the progress of the center of mass of that person, until he missteps his (step 4), placing his right foot right below his center of mass with no ability to counter weight shift over the right foot to the side. Instinctively he crosses over with his left foot (5) followed by placing the right foot to the side to counter the center of weight shift and continues an almost uninterrupted gait (6).

FIG. 7*e* is a schematic illustration of the shifting of the center of mass during gait of a person with a balance disability or slow responses, and the regaining of balance after momentary loss of balance. Here after a series of balanced steps (1,2,3) a misstep (4) of the right foot occurs. The slowly responding person will then performs an additional short step with his left foot (5) followed by additional right step placed well to the side (6) to counter the weight shift, and then regain walking by normal left step (7). In several; cases the extra left step followed by a side place right step may lead to loss of balance during gait resulting in a fall.

Figure 7F:
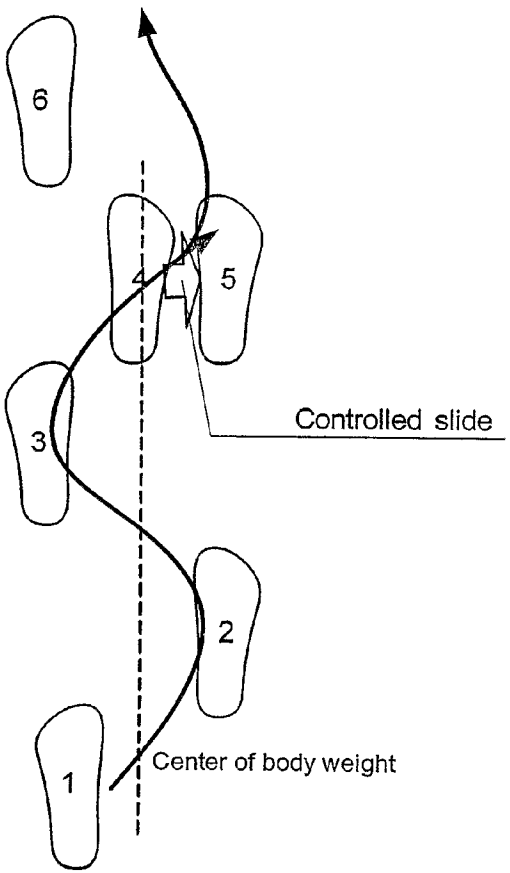
FIG. 7*f* is a schematic illustration of the shifting of the center of mass during gait, and the regaining of balance imparted by a device for regaining balance, in accordance with a preferred embodiment of the present invention.

FIG. 7*f* is a schematic illustration of the shifting of the center of mass during gait, and the regaining of balance imparted by a device for regaining balance, in accordance with a preferred embodiment of the present invention. Here as the misstep occurs (4) the device of the present invention slides the same foot sideways to the right, thus maintaining the center of mass over the support area of the person, helping him to regain balance and continue normal walking.

Figure 8A:
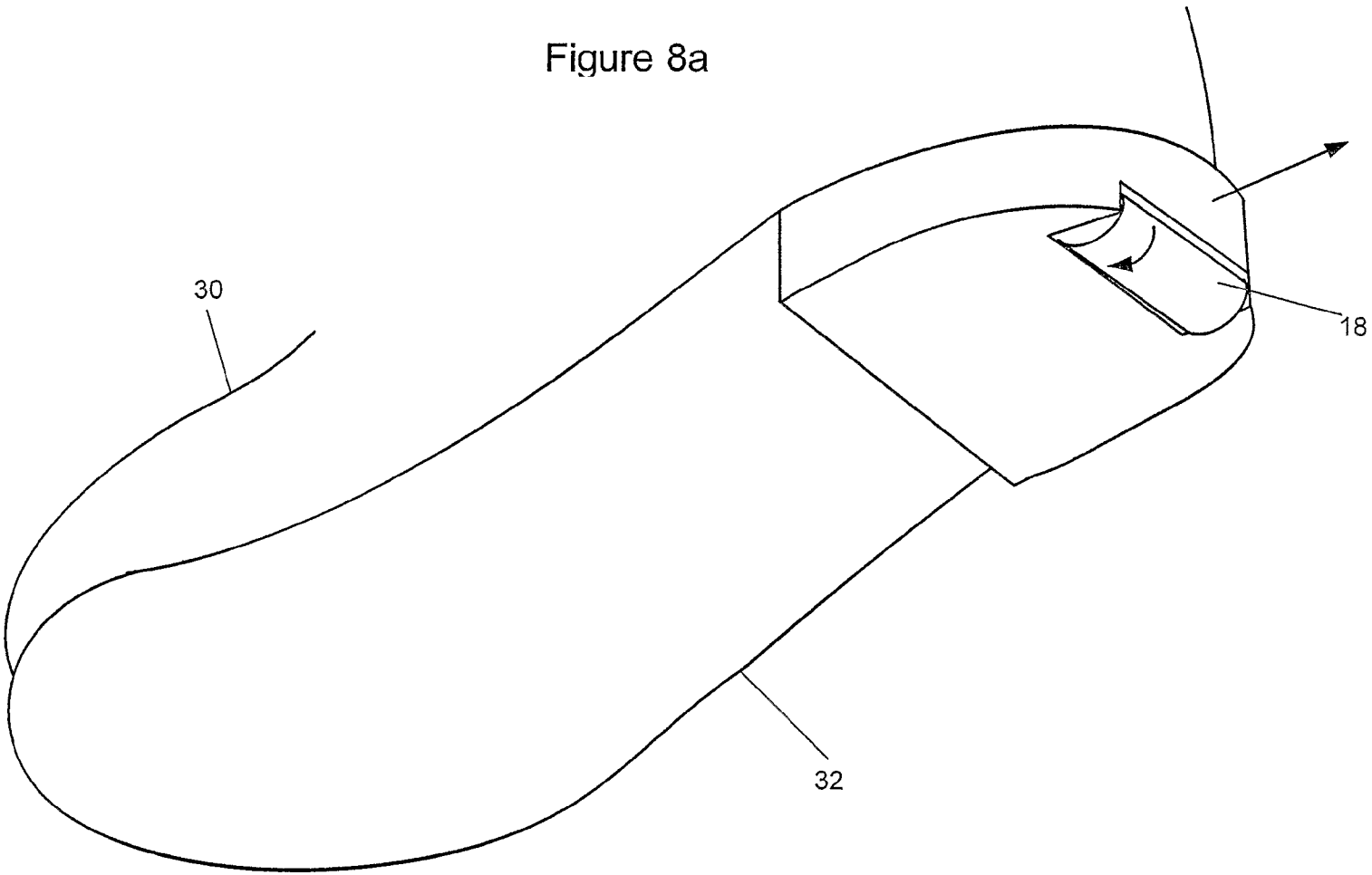
FIG. 8*a* is an illustration of a typical installation of a backward driving wheel in the sole of a shoe, according to a preferred embodiment of the present invention.
Figure 8B:
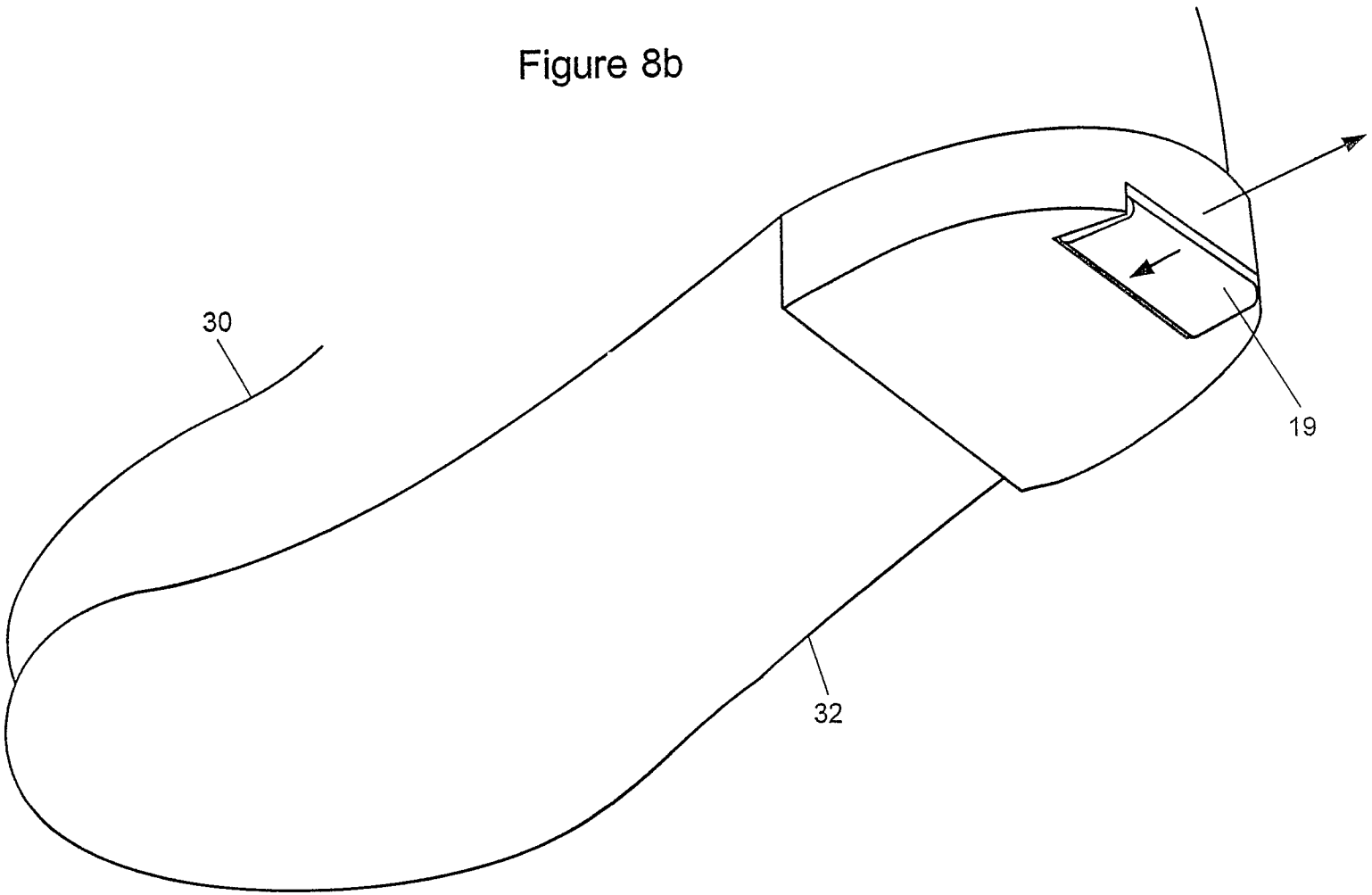
FIG. 8*b* is an illustration of a typical installation of a backward driving belt in the sole of a shoe, according to a preferred embodiment of the present invention.

An example of the installation and operation of the device with a drive wheel (18) is demonstrated in FIG. 8*a*. The wheel (18) is installed at the back edge of the heel, in the sole (32), in a way that it does not protrude to the back or from the sole bottom. When a person shifts his weight backwards (for any reason) most of the weight is supported by the wheel. The sensors detect this chance of weight distribution, thus the wheel is rotated by the motor, and the shoe moves backwards. FIG. 8*b* presents another preferred embodiment of the device, where the wheel is replaced by a belt drive (19), which is supported by two or more wheels (see also FIG. 3*b*).

Figure 8C:
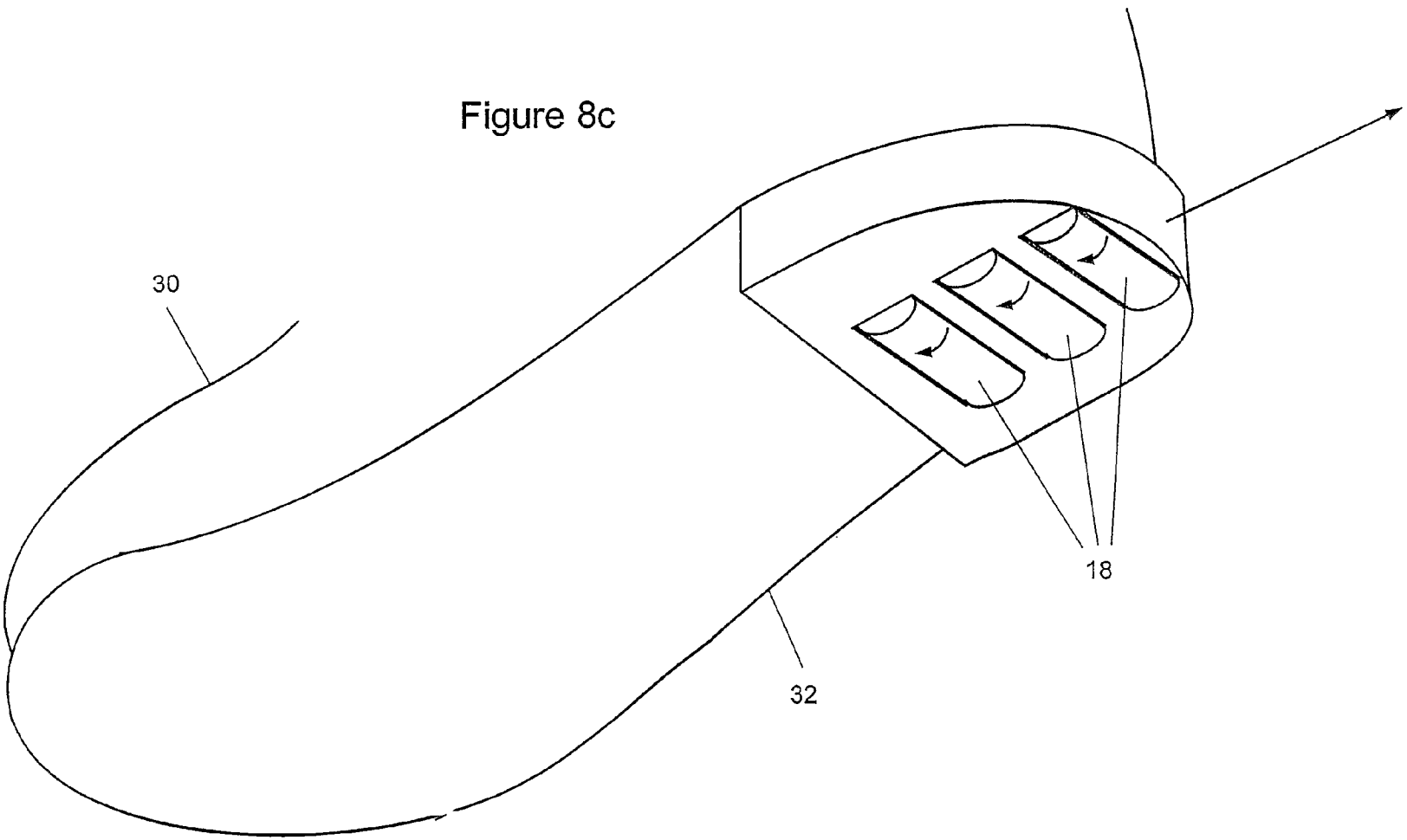
FIG. 8*c* is an illustration of a typical installation of three backward driving wheels in the sole of a shoe, according to a preferred embodiment of the present invention.

FIG. 8*c* is an illustration of a typical installation of three backward driving wheels in the sole of a shoe, according to a preferred embodiment of the present invention.

Figure 9:
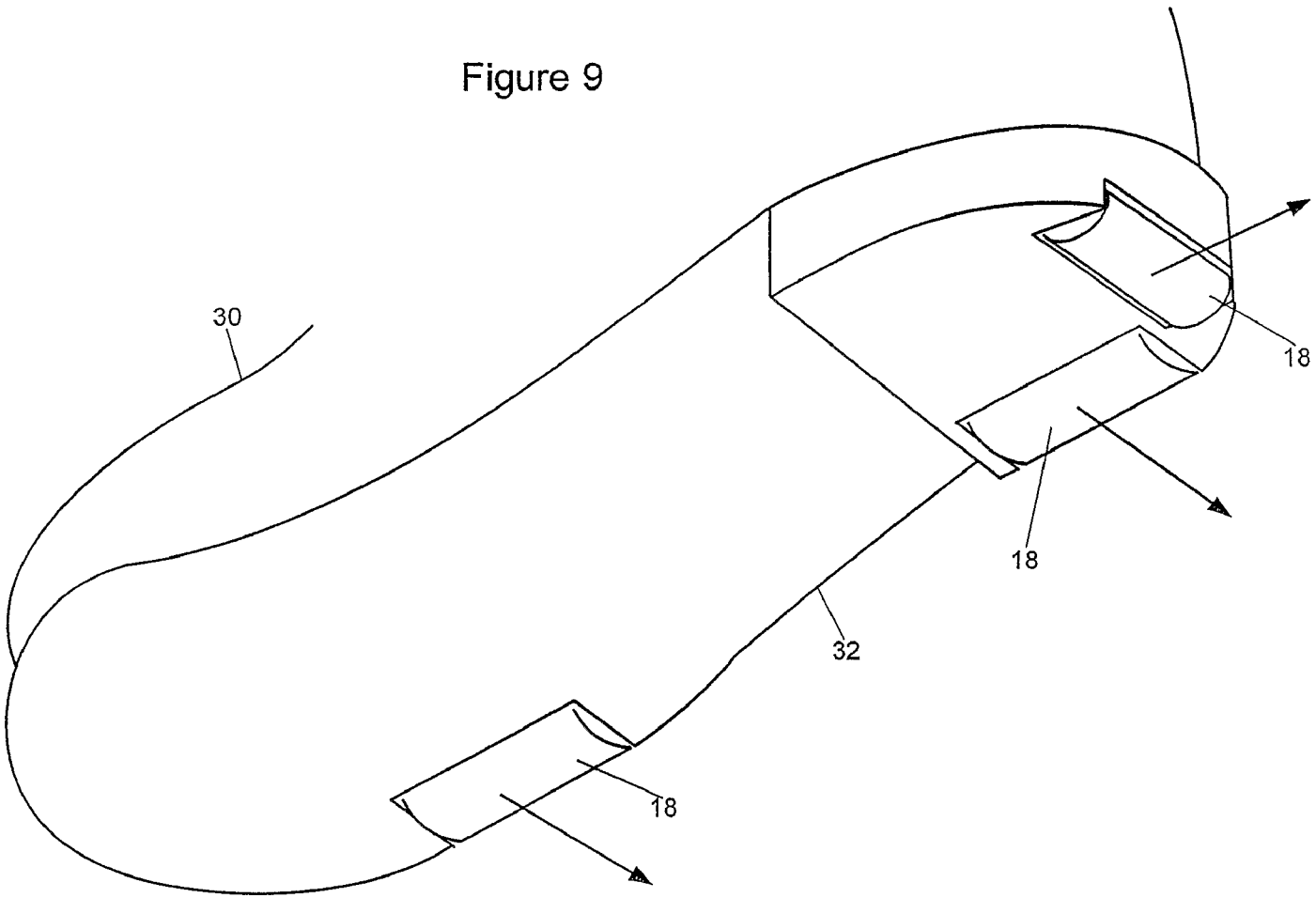
FIG. 9 is an illustration of a typical installation of driving wheels in the shoe sole for displacing the foot of the wearer of the shoe either backwards or sideways.

Another preferred embodiment is detailed in FIG. 9. In this embodiment three sets of wheels (18) are installed in the sole of the shoe (32). The additional wheels are aimed at assisting in sideways imbalance situations. The additional, side drive wheel, can be installed in the heel area, in the area of the front section of the foot, or in both. However, moving the heel sideways may be less comfortable than moving the front section of the foot, a movement which is more natural to the body. Thus a wheel in the front section of the foot may be more comfortable for the user. If parallel sideways movement is required, two wheels are preferably used. One at the back of the sole (heal area) and another in the front of the sole (toes area).

In yet another embodiment, when diagonal movement is required, the wheels maybe installed at an angle to the main axis of the shoe.

Figure 10A:
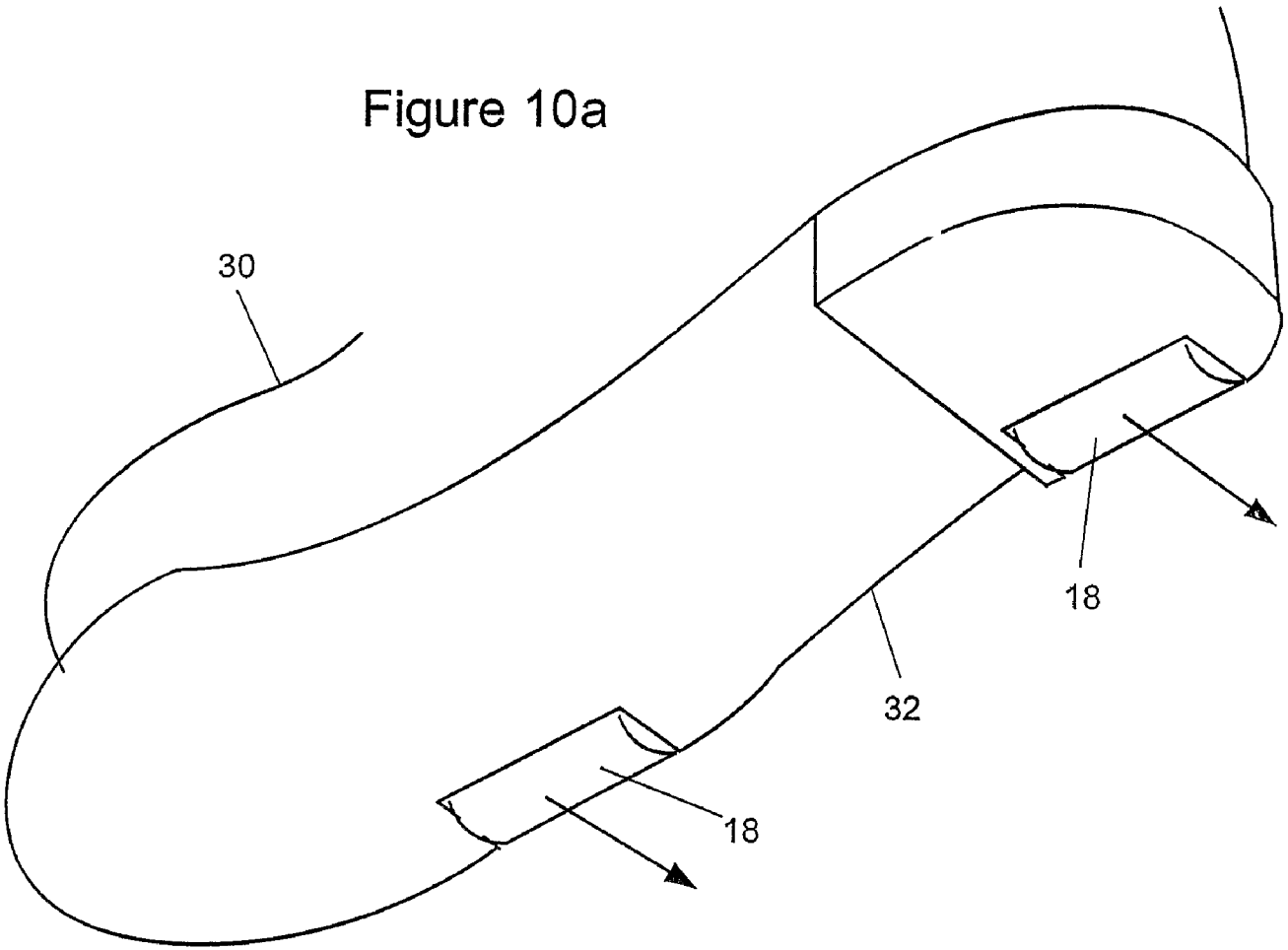
FIG. 10*a* is an illustration of a typical installation of driving wheels in the shoe sole for displacing the foot of the wearer of the shoe sideways.

FIG. 10*a* is an illustration of a typical installation of driving wheels in the shoe sole for displacing the foot of the wearer of the shoe sideways.

Figure 10C:
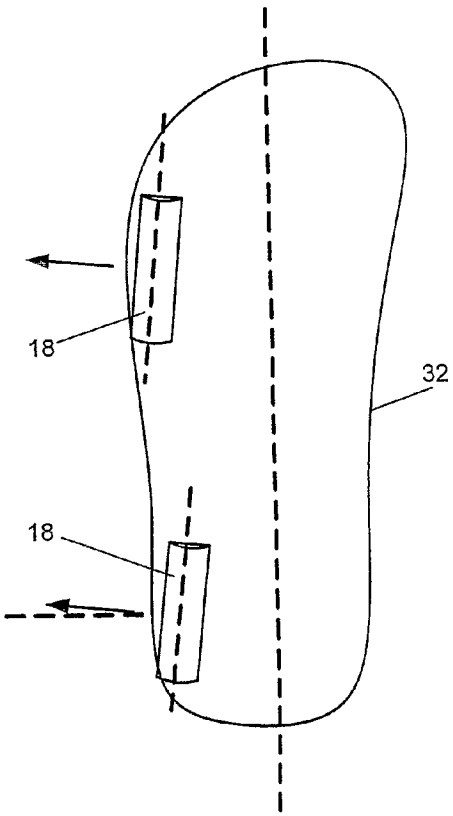
FIG. 10*c* is an illustration of a typical installation of driving wheels in the shoe sole for displacing the foot of the wearer of the shoe sideways (diagonally to the direction of gait).
Figure 10B:
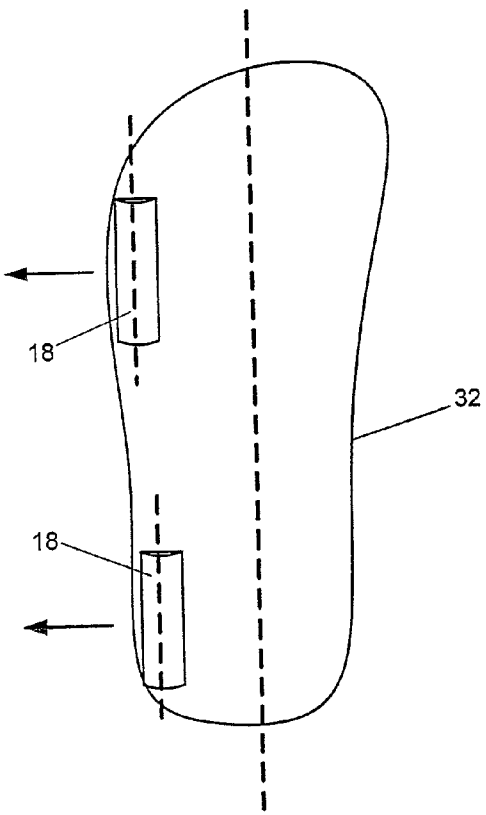
FIG. 10*b* is an illustration of a typical installation of driving wheels in the shoe sole for displacing the foot of the wearer of the shoe sideways (substantially perpendicular to the direction of gait).

FIG. 10*b* is an illustration of a typical installation of driving wheels in the shoe sole for displacing the foot of the wearer of the shoe sideways (substantially perpendicular to the direction of gait).

FIG. 10*c* is an illustration of a typical installation of driving wheels in the shoe sole for displacing the foot of the wearer of the shoe sideways (diagonally to the direction of gait).

Figure 10E:
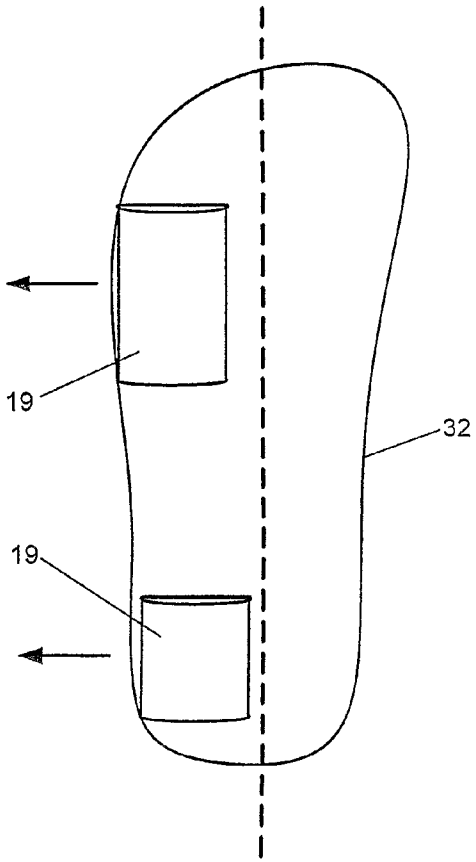
FIG. 10*e* is an illustration of a typical installation of driving wheels in the shoe sole for displacing the foot of the wearer of the shoe sideways (with rotating belts).
Figure 10D:
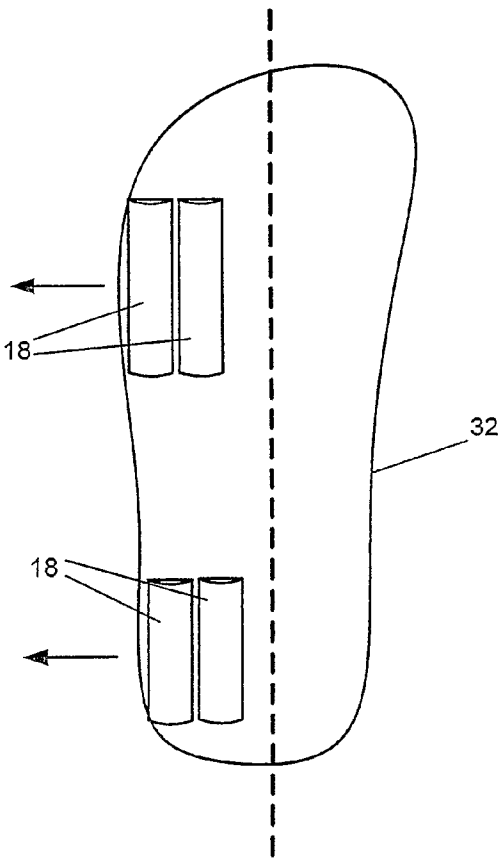
FIG. 10*d* is an illustration of a typical installation of driving wheels in the shoe sole for displacing the foot of the wearer of the shoe sideways (with pairs of wheels).

FIG. 10*d* is an illustration of a typical installation of driving wheels in the shoe sole for displacing the foot of the wearer of the shoe sideways (with pairs of wheels).

FIG. 10*e* is an illustration of a typical installation of driving wheels in the shoe sole for displacing the foot of the wearer of the shoe sideways (with rotating belts).

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

The invention claimed is:

1. A device for assisting a user in avoiding losing balance and tripping, the device comprising:

a footwear device to be attached to a foot of the user standing or walking on a surface, the footwear device including:

at least one sensor for sensing changes in weight distribution of the foot on the surface indicative of an imminent tripping hazard of the user; and a controller for receiving signals from said at least one sensor indicative of the imminent tripping hazard and for actuating at least one propulsion unit, said at least one propulsion unit including at least one rolling element located at and at least partially confined within a heel of the footwear device for moving the foot of the user in a desired direction and a determined distance across the surface, such that the center of the body weight of the user is brought over a support area under the user when the imminent tripping hazard is sensed, wherein said at least one rolling element is prevented from rolling at all times except when activated by the propulsion unit when the imminent tripping hazard is sensed.

2. The device of claim 1, wherein the propulsion unit comprises a motor coupled to the rolling element.

3. The device of claim 2, wherein the rolling element comprises at least one wheel.

4. The device of claim 2, wherein the rolling element comprises a belt.

5. The device of claim 1, wherein the propulsion unit is provided with a surface of enhanced friction.

6. The device of claim 1, wherein the propulsion unit is powered by at least one battery.

7. The device of claim 1, wherein said at least one sensor is selected from the group consisting of: weight activated mechanical switches, strain gauges, piezoelectric sensors, electronic sensors.

8. The device of claim 1, wherein the footwear device comprises a shoe.

9. The device of claim 1, further provided with a communication unit for communicating information to or from an external unit.

10. The device of claim 9, wherein the device also includes a receiver for receiving information from a communication unit associated with other foot of the user.

11. The device of claim 1, wherein the propulsion unit provides propulsion for displacing the foot of the user along one axis.

12. The device of claim 1, wherein said at least one rolling element comprises two or more rolling elements each rotatable about a different axis.

13. A method for assisting a user standing or walking on a surface in avoiding losing balance and tripping, the method comprising:

providing a footwear device to be attached to a foot of the user which includes at least one sensor for sensing changes in weight distribution of the foot on the surface indicative of an imminent tripping hazard of the user; a controller for receiving signals from said at least one sensor indicative of the imminent tripping hazard and for actuating at least one propulsion unit, said at least one propulsion unit including at least one rolling element located at and at least partially confined within a heel of the footwear device for moving the foot of the user in a desired direction and a determined distance across the surface, such that the center of the body weight of the user is brought over a support area under the user when the imminent tripping hazard is sensed;

sensing the imminent tripping hazard;

moving said foot of the user in the desired direction and determined distance across the surface, such that the center of the body weight of the user is brought over the support area under the user; and preventing said at least one rolling element from rolling at all times except when activated by the propulsion unit when the imminent tripping hazard is sensed.

14. The method of claim 13, wherein the foot is moved along one axis.

15. The method of claim 14, wherein the foot is moved along more than one axis.

16. The method of claim 13, further comprising providing a communication unit for communicating information to or from an external unit.

17. The method of claim 16, wherein information is communicated to the communication unit and a communication unit associated with other foot of the user.

* * * * *